United States Patent [19]

Yamada

[11] Patent Number: 4,991,418

[45] Date of Patent: Feb. 12, 1991

[54] METHOD FOR DETERMINING TEMPERATURE OF METAL TO BE ROLLED BY HOT STRIP MILL AND APPARATUS FOR PERFORMING THE SAME

[75] Inventor: Fumio Yamada, Hachioji, Japan

[73] Assignee: Kabushiki Kaisha Toshiba, Kawasaki, Japan

[21] Appl. No.: 409,723

[22] Filed: Sep. 20, 1989

[30] Foreign Application Priority Data

Sep. 20, 1988 [JP] Japan ..... 63-236051

[51] Int. Cl.[5] ..... B21B 37/10

[52] U.S. Cl. ..... 72/11; 72/13; 72/202

[58] Field of Search ..... 72/13, 11, 8, 9, 202

[56] References Cited

U.S. PATENT DOCUMENTS 4,068,511 1/1978 Petrus ..... 72/13

FOREIGN PATENT DOCUMENTS 40-21965 9/1965 Japan ..... 72/13
47-40187 10/1972 Japan ..... 72/13
60-124411 7/1985 Japan ..... 72/13
61-289908 12/1986 Japan ..... 72/13
63-199008 8/1988 Japan ..... 72/13

*Primary Examiner*—Robert L. Spruill
*Assistant Examiner*—T. C. Schoeffler
*Attorney, Agent, or Firm*—Foley & Lardner, Schwartz, Jeffery, Schwaab, Mack, Blumenthal & Evans

[57] ABSTRACT

In a hot strip mill having a roughing mill, a finishing mill including a plurality of stands and a delay table having a coil box and being disposed between the roughing mill and the finishing mill, a temperature drop in the delay table is calculated for a model of the coil box portion and a model of the remaining portion of the delay table. The bar temperature on an entry side of the coil box is not calculated from the surface temperature on a delivery side of the roughing mill but from an average temperature obtained by operations. The lowering of the temperature of a bar on the delay table is obtained by only one non-repetitive calculation.

9 Claims, 5 Drawing Sheets

METHOD FOR DETERMINING TEMPERATURE OF METAL TO BE ROLLED BY HOT STRIP MILL AND APPARATUS FOR PERFORMING THE SAME

FIELD OF THE INVENTION

The present invention relates to a method for determining the temperature of a hot metal to be rolled by a finishing mill when it is supplied from a roughing mill through a delay table having a coil box thereto, and an apparatus for performing the same.

BACKGROUND OF THE INVENTION

A hot strip mill for rolling a hot metal workpiece generally includes a roughing mill and a finishing mill. In such a case, a roll gap of the finishing mill and a rolling speed thereof have been set by calculations such that the size and temperature of rolled metal at a delivery side of the finishing mill become as required.

Such conventional setup calculations will be described in brief with reference to FIG. 5.

A roughing mill RM in FIG. 5 comprises a single mill stand having reversible rolls and a hot metal or a hot bar, which after having been rolled an odd number of times by the roughing mill, is supplied to a finishing mill FM composed of a plurality of mill stands $F_l, \ldots, F_n$. In the finishing mill, the metal is rolled sequentially by the respective stands to obtain a rolled metal having predetermined size.

In general, the roll gaps and rolling speeds of the respective stands of the finishing mill are determined preliminarily before the hot metal from the roughing mill is supplied to the respective stands $F_i$ ($i=1, 2, \ldots, n$). After the hot metal enters into the respective stands, the thickness of the hot metal from the respective stands $F_i$ are maintained at the predetermined values under the control of an automatic gauge control device. Therefore, the setup calculations for the finishing mill are performed for a top end portion of the metal to minimize off-gauge portions. The term "top end portion" means a portion of the metal which is inside an actual top end of the plate by a distance of several meters.

In the setup calculations for conventional finishing mill, the temperature $T_{RD}$ of the top end portion of the metal in the final pass by which the metal leaves the roughing mill RM is detected by a pyrometer RDT provided on a delivery side of the roughing mill at a time 1 shown in FIG. 5. Then, the metal is transported on a delay table arranged between the roughing mill RM and the finishing mill FM to a position on the entry side of the finishing mill FM in which a pyrometer FET is provided. The temperature $T_{FE}$ of the top end portion of the metal is measured by the pyrometer FET at a time 2. The temperature of the metal of which the top end portion passes through the respective stands $F_i$ of the finishing mill FM are estimated preliminarily at a time 1 when the temperature $T_{RD}$ of the top end portion of the metal is Obtained. In FIG. 5, the metal temperature $T_1$ is estimated at a time 3 when its top end portion enters into the first stand $F_1$. The conditions of a scale breaker FSB are then considered. In this manner, the roll gaps of the respective stands $F_i$ are set on the basis of the metal temperature at the respective stands $F_i$ in such a way that the thickness of the metal at the delivery side of the respective stands becomes the predetermined values. Furthermore, the roll speeds at the respective stands $F_i$ are set at a time when the temperature $T_{FE}$ of the top end portion of the metal is obtained by taking the temperature drop in the finishing mill FM into consideration so that the temperature $T_{FD}$ of the top end portion of the metal passing through the pyrometer FDT provided in the delivery side of the final stand $F_n$ at a time 4 becomes the objective temperature.

It is a recent tendency that a coiler having no mandrell, referred to as a coil box, is arranged on a delay table between the roughing mill and the finishing mill in order to improve the space economy, to reduce the amount of skid marks formed in a heating furnace provided upstream thereof and to minimize the energy consumption, etc.

In such a coil box, the top end and the tail end of the bar are reversed by winding and rewinding, and the temperature variation of the wound bar is substantially different from that on the delay table.

It is impossible to directly apply the conventional setup of the finishing mill to such a construction of the hot strip mill. A typical example of a temperature estimation of metal in a finishing mill having a coil box is disclosed in U.S. Pat. No. 4,068,511. According to the temperature estimation method disclosed in this patent, the delay table is divided into a coil box portion and the remaining portion and the bar temperature at an entry side of the finishing mill is obtained by sequential calculation of the temperatures of respective portions using the bar temperature at a delivery side of a roughing mill as an initial value. Defects of this method are that, due to the fact that the initial temperature is a detection value from the pyrometer RDT disposed on the delivery side of the roughing mill, i.e., a surface temperature of the bar, it is necessary, in order to minimize the estimation error in the calculation, to repeat the calculation at constant intervals, and it is also necessary to prepare a heat loss compensation table to estimate the temperature drop in the coil box and to repeatedly refer to the table for every calculation.

SUMMARY OF THE INVENTION

An object of the present invention is to provide a method and apparatus for determining the temperature of a metal to be rolled by a hot strip mill by precisely and easily estimating a strip temperature on an entry side of a finishing mill thereof even when a coil box is provided between a roughing mill thereof and the finishing mill.

Another object of the present invention is to provide a method and apparatus for determining the temperature of a metal to be rolled by a hot strip mill by precisely and easily estimating the bar temperature on an entry side of a finishing mill thereof without the necessity of using a heat loss compensation table and/or repeated calculations even when a coil box is provided between a roughing mill thereof and the finishing mill.

In order to achieve the above and other objects, according to the present invention, a temperature drop of a bar on a delay table of a hot strip mill having a roughing mill and a finishing mill including a plurality of stands and the delay table having a coil box and being disposed between the roughing mill and the finishing mill, is calculated for a model of the coil box portion and a model of the remaining portion of the delay table. The bar temperature on an entry side of the coil box is not calculated from the surface temperature on an delivery side of the roughing mill, but from the average temperature obtained by calculation. The bar temperature drop on the delay table is obtained by only one calculation. By determining the strip temperatures at respective stands of the finishing mill in this manner, it is possible to easily and precisely obtain the strip temperature and thickness of the strip on the delivery side of the finishing mill.

DETAILED DESCRIPTION OF THE PREFERRED EMBODIMENT

Figure 1:
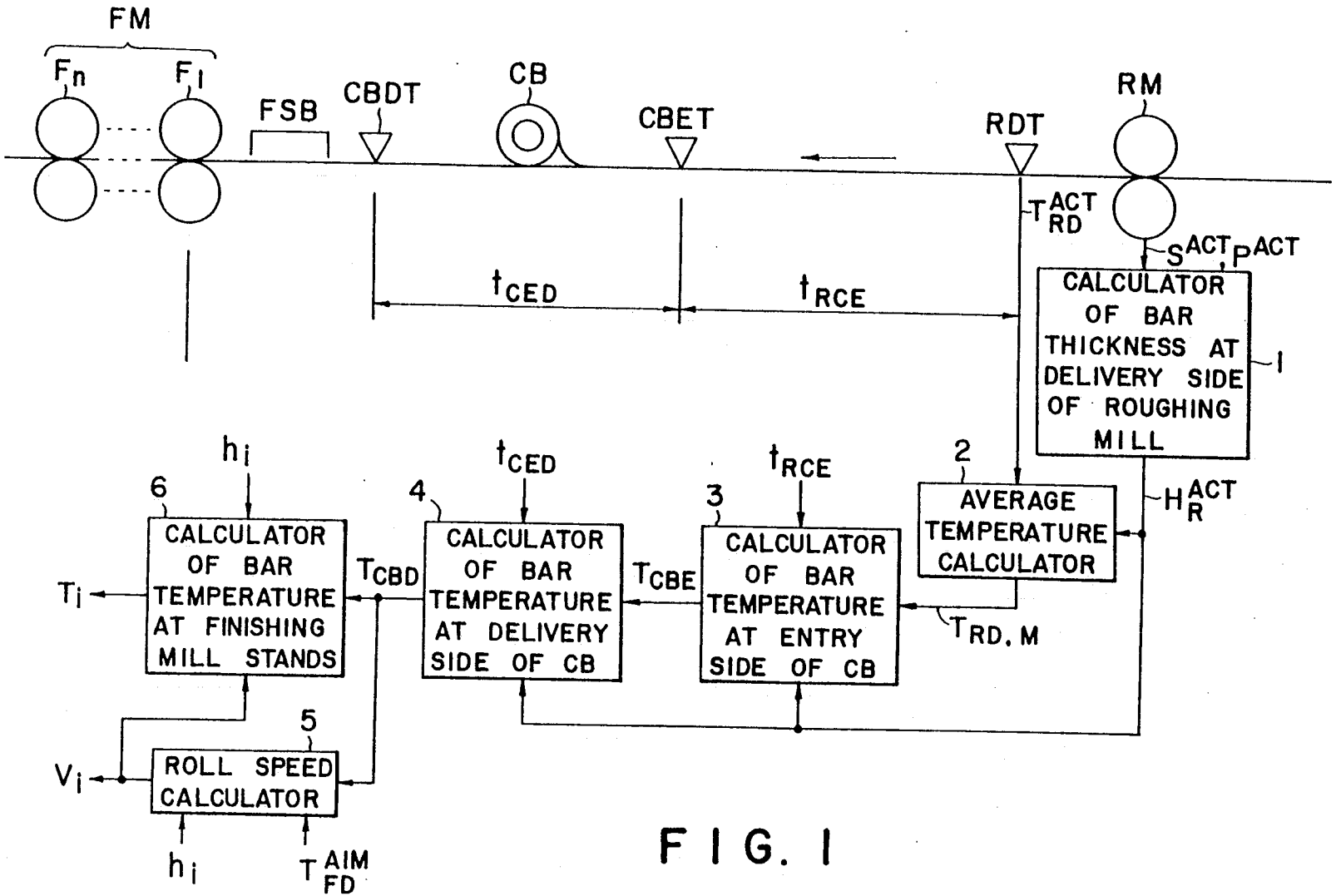
FIG. 1 is a block diagram showing an embodiment of a setting device of a hot strip mill according to the present invention.

A hot strip mill shown in FIG. 1 comprises a roughing mill RM, a finishing mill FM including a plurality of rolling mill stands $F_1$, $F_2$, . . . , $F_n$ and a delay table disposed between the rOughing mill and the finishing mill and including an open portion and a coil box CB. In order to detect a bar exiting the roughing mill and the temperature thereof, a pyrometer RDT is arranged on a delivery side of the roughing mill RM. In order to detect the passage of the bar through the coil box, an entry side detector CBET and a delivery side detector CBDT are arranged on an entry side and a delivery side of the coil box CB, respectively. A hydraulic scale breaker FSB is provided between the delivery side detector CBDT and the finishing mill FM to remove scale from the bar entering into the finishing mill FM.

In order to estimate the temperatures of the strip at the respective rolling mill stands $F_1$, $F_2$, . . . , $F_n$ of the finishing mill FM when it enters into the latter, a thickness calculator 1 for obtaining the thickness of the bar exiting the roughing mill RM, an average temperature calculator 2, a temperature calculator 3 for obtaining the temperature of the bar entering into the coil box CB, a temperature calculator 4 for obtaining the temperature of the bar on the delivery side of the coil box CB, a roll speed calculator 5 and a temperature calculator 6 for obtaining temperatures of the strip at the respective roll mill stands are provided.

Before describing the functions of the calculators 1 to 6, the principle of the present invention will be described.

Considering the air-cooling of an upper and a lower surface of the bar, also referred to as transfer bar, disposed on the delay table, the heat balance can be represented by $$c \cdot p \cdot dB \cdot dl \cdot HdT = -q \cdot dB \cdot dl \cdot dt \ldots \quad (1)$$

Further, boundary condition becomes as follows.

$$q = 2\epsilon\sigma\{(T+273)^4 - (T_A+273)^4\} \ldots \quad (2)$$

where c : specific heat (Kcal/kg° C.)
p : density (kg/m$^3$)
dB: unit width (m)
dl: unit length (m)
H: thickness (m)
dT: temperature variation (° C.)
q: heat rate (Kcal/m$^2$ hr)
dt: time variation (hr)
$\epsilon$: emissivity
$\sigma$: Stefan-Boltzmann constant (Kj/m$^2$ hr K$^4$)
T: bar temperature (° C.)
$T_A$: ambient temperature (° C.)

A solution of equation (1) is obtained by inserting equation (2) into equation (1) and assuming the following.

$$(T+273)^4 > (T_A+273)^4 \ldots \quad (3)$$

which is as follows:

$$T_{CBE} = \left[ (T_{RD} + 273)^{-3} + \frac{6\epsilon\sigma \cdot t_{RCE}}{c\rho\, H_R} \right]^{-\frac{1}{3}} - 273 \quad (4)$$

where $T_{CBE}$: transfer bar temperature (° C.) measured at the entry side detector CBET
$T_{RD}$: transfer bar temperature (° C.) measured at the delivery side of the roughing mill
$t_{RCE}$: transportation time (hr) of the bar from the roughing mill to the entry side detector
$H_R$: transfer bar thickness (m)

Figure 4:
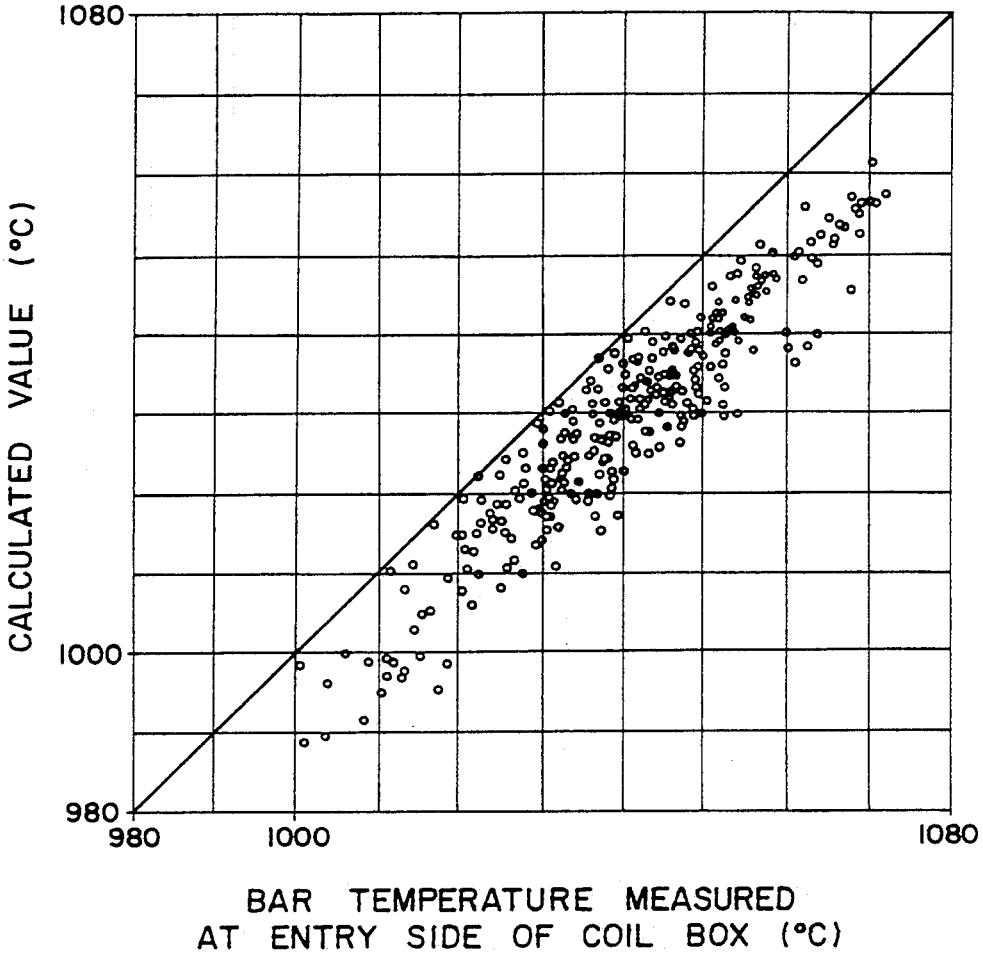
Figure 5:
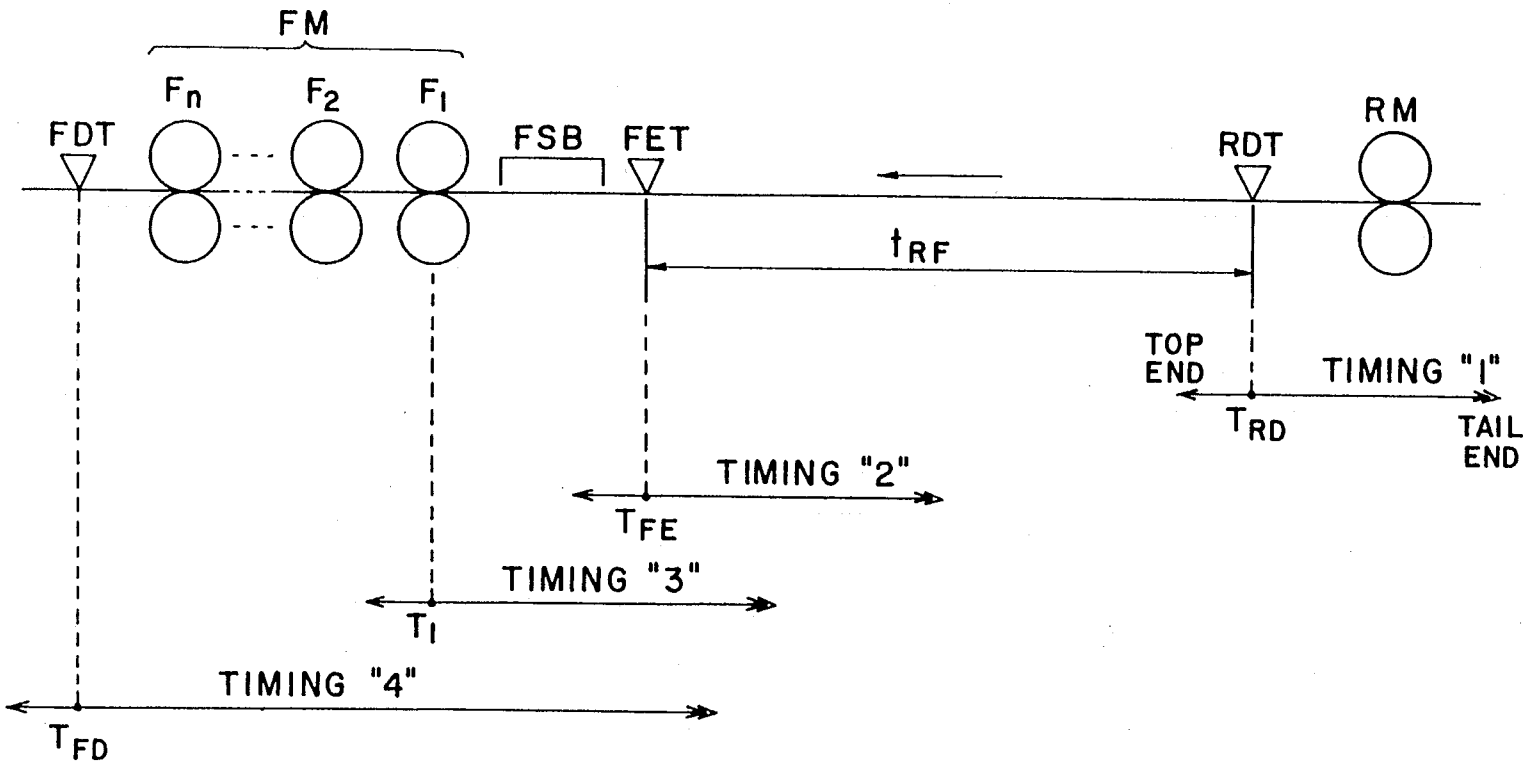
FIG. 5 PRIOR ART
FIG. 5 is a timing chart for explanation of a conventional finishing mill setup calculations.

When a measured temperature of the transfer bar at the exit side of the roughing mill, i.e., the surface temperature $T_{RD}^{ACT}$ is directly used as the temperature $T_{RD}$ in the equation (4), a calculated temperature may become much different from the measured temperature obtained by the entry side detector CBET, as shown in FIG. 4. This might be due to the fact that heat recovery immediately after the rolling by the roughing mill is not sufficient and only the surface temperature is locally dropped. Therefore, the temperature $T_{RD}$ in the equation (4) should be an average temperature $T_{RD,M}$ in the direction of the thickness of the bar. In order to estimate this $T_{RD,M}$, data obtained in an actual plant was analyzed. According to the analysis, it has been found that $T_{RD,M}$ can be easily approximated by $$T_{RD,M} = T_{RD}^{ACT} + a \cdot H_R^{ACT} + b \ldots \quad (5)$$

where a and b are constants. The equation (5) shows that the larger the $H_R^{ACT}$, the smaller the heat recovery, resulting in a larger temperature difference between the surface and an interior of the bar.

As is clear from the equation (5), the average temperature can be easily obtained by correcting the measured temperature $T_{RD}^{ACT}$ of the bar at the delivery side of the roughing mill with the bar thickness $H_R$.

Figure 3:
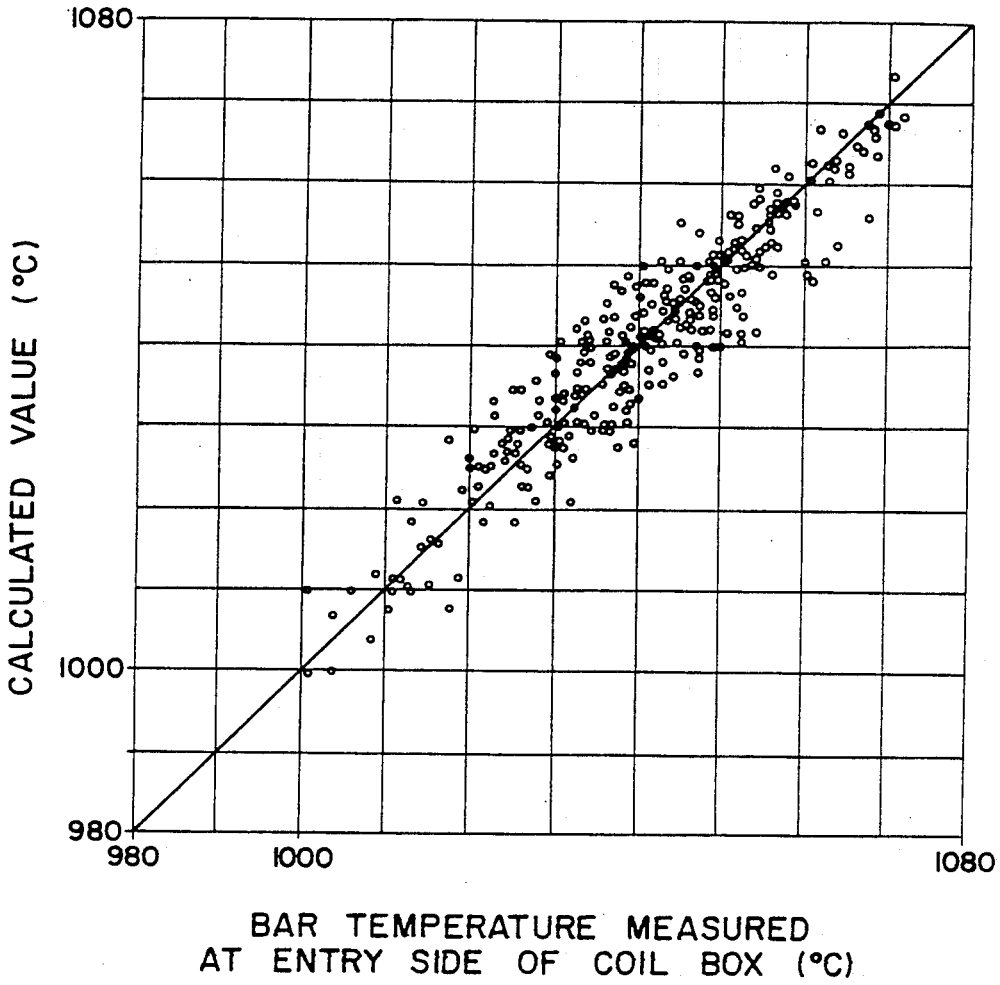
FIGS. 3 and 4 are graphs indicating the accuracy of average temperature estimation of a bar on a delivery side of a roughing mill.

Generally, it is considered that, even if heat recovery on the delivery side of the roughing mill is insufficient, the temperature gradient inside the bar becomes smaller and smaller during transportation thereof over the long delay table, so that the temperature distribution in the bar at a location corresponding to the entry side detector CBET is substantially uniform. Therefore, the temperature measured by the entry side detector can be considered to be very close to the average temperature of the bar. FIG. 3 shows a comparison of the temperature measured by the entry side detector with the calculated temperature when the average temperature correction is made on the delivery side of the roughing mill. As is clear from FIG. 3, it is possible to obtain a precise estimation by performing the average temperature correction on the delivery side of the roughing mill.

The $H_R^{ACT}$ to be used in the equation (5) can be calculated from rolling force $p^{ACT}$ (ton) and the roll gap setup value $S^{ACT}$ (m) in the final pass of the roughing mill according to the following gauge meter equation (6).

$$H_R^{ACT} = S^{ACT} + \frac{p^{ACT}}{M} + C \tag{6}$$

where

M: mill modulus (ton/m)

C: constant

Since a wrap to which a top end portion of the bar belongs is located at the outermost periphery in the coil box, one surface thereof contacts with an adjacent wrap and the other surface thereof is exposed to air. According to the theory of heat loss, this situation may correspond to a one-sided adiathermic state and the heat loss corresponds to half of the heat loss on the delay table.

Therefore, together with the temperature drop (the equation (4)) of the coil box, the following relation is established between the bar temperatures $T_{CBE}$ and $T_{CBD}$ measured by the entry side detector and the delivery side detector, respectively:

$$T_{CBD} = \left[ (T_{CBE} + 273)^{-3} + \frac{3\epsilon\sigma \cdot t_{CED}}{c\rho\, H_R} \right]^{-\frac{1}{3}} - 273 \tag{7}$$

where $T_{CBE}$: transfer bar temperature (° C.) measured by the entry side detector, $t_{CED}$: transportation time (hr) from the entry side detector to the delivery side detector.

In this manner, by sequentially calculating the temperatures of the bar on the table portion and in the coiler portion while being transported on the delay table, the temperature thereof in the entry side of the finishing mill and which is necessary to set the finishing mill (i.e., the transfer bar temperature $T_{CBD}$ to be measured by the delivery side detector), can be easily calculated. In this setup calculation, it is preferable in order to improve the accuracy of temperature estimation, to measure the bar temperature at a position as close to the finishing mill as possible. In order to realize this, it has been proposed to dispose a pyrometer for detecting the temperature of a bar entering into the finishing mill. However, scale is formed on the surfaces of the bar while being transported on the delay table, and this creates difficulties in measuring the true temperature of the bar at the position where it enters the finishing mill. Therefore, it is usual to set the finishing mill on the basis of the temperature of the bar measured at the leaving position of the roughing mill, as the initial temperature. With the temperature at the entry side of the finishing mill determined as above, the speeds of the respective mill stands of the finishing mill for obtaining the objective temperature at the delivery side of the finishing mill can be determined according to the following equations (8) and (9), respectively.

$$V_n = -((2\alpha_F \Sigma L_i)/(c\rho h_n))/\log_e((T_{FD}^{AIM} - T_W)/(T_{CBD} - T_w)) \ldots \tag{8}$$

$$V_i = ((1+f_n)V_n h_n/(1+f_i)h_i) \ldots \tag{9}$$

where $\alpha_F$: equivalent heat transfer coefficient (Kj/m$^2$ hr ° C.)

$\Sigma L_i$: total length of inter-stand distances (m)

$T_{FD}^{AIM}$: objective temperature at delivery side of finishing mill (° C.)

$T_w$: scale-breaking water temperature (° C.)

$V_n$: peripheral roll speed of the final mill stand (mpm)

$V_i$: peripheral roll speed of i-th mill stand (mpm)

$f_n$: forward slip factor of the final mill stand $f_i$: forward slip factor of i-th stand $h_i$: bar thickness at the exit side of i-th stand (m)

$h_n$: bar thickness at the exit side of the final mill stand (m)

The strip temperature $T_i$ (i=1, 2, ..., n) at the respective mill stands can be obtained by the following equation:

$$T_i = T_w + (T_{i-1} - T_w)exp(-2\alpha_F L_{i-1}/(c\rho_n V_n)) \ldots \tag{10}$$

where $T_i$: strip temperature in i-th mill stand (° C.)

$L_{i-1}$ cooling distance between (i−1)-th mill stand and i-th mill stand (m)

With the strip temperatures $T_i$ at the respective mill stands obtained in this manner, the roll gaps of the respective mill stands of the finishing mill are set by using the known deformation-resistance equation and rolling force equation.

The present invention is embodied on the basis of the principle mentioned hereinbefore.

The calculator 1 for calculating the thickness of the bar at the delivery side of the roughing mill calculates, by using, for example, the equation (6), the thickness $H_R^{ACT}$ of the bar on the basis of the roll gap $S^{ACT}$ and the rolling force $p^{ACT}$ of the roughing mill when the tail end portion of the bar reaches the roughing mill RM. The average temperature calculator 2 uses equation (5) to calculate the average temperature $T_{RD,M}$ of the bar in the direction of the thickness, on the basis of the bar surface temperature $T_{RD}^{ACT}$ measured by the pyrometer RDT on the delivery side of the roughing mill and the thickness (transfer bar thickness) $H_R^{ACT}$ at a time when the tail end portion of the bar exits the roughing mill.

The temperature calculator 3 for calculating the temperature of the bar at the entry side of the coil box CB uses equation (4) to calculate the temperature $T_{CBE}$ of the bar at the entry side of the coil box CB (at the position of the entry side detector CBET in FIG. 1) on the basis of the transportation time $t_{RCE}$ of the bar from the roughing mill RM to the entry side detector CBET, the thickness $H_R^{ACT}$ thereof at the delivery side of the roughing mill and the average temperature $T_{RD,M}$. The temperature calculator 4 for calculating the temperature of the bar at the delivery side of the coil box CB uses equation (7) to calculate the temperature $T_{CBD}$ of the bar at the delivery side of the coil box CB (at a position of the delivery side detector CBDT in FIG. 1) on the basis of the transportation time $t_{CED}$ of the bar from the entry side detector CBET to the delivery side detector CBDT, the bar thickness $H_R^{ACT}$ on the delivery side of the roughing mill and the output $T_{CBE}$ of the CB entry side temperature calculator 3.

The roll speed calculator 5 uses equations (8) and (9) to calculate the roll speeds (peripheral) $V_i$ of the respective mill stands $F_i$ on the basis of the output $T_{CBD}$ of the CB delivery side temperature calculator 4, the objective value $T_{FD}^{AIM}$ of the strip at the delivery side of the finishing mill (i.e., the aimed temperature at the delivery side of the final mill stand) and the objective thickness values hi of the strip at the respective mill stands $F_i$. The finishing mill stand temperature calculator 6 calculates the temperatures $T_i$ of the strip at the respective mill stands on the basis of the output $T_{CBD}$ of the CB delivery side temperature calculator 4, the roll speeds $V_i$ of the respective stands $F_i$ and the objective thicknesses $h_i$ of the strip at the respective stands $F_i$.

Figure 2:
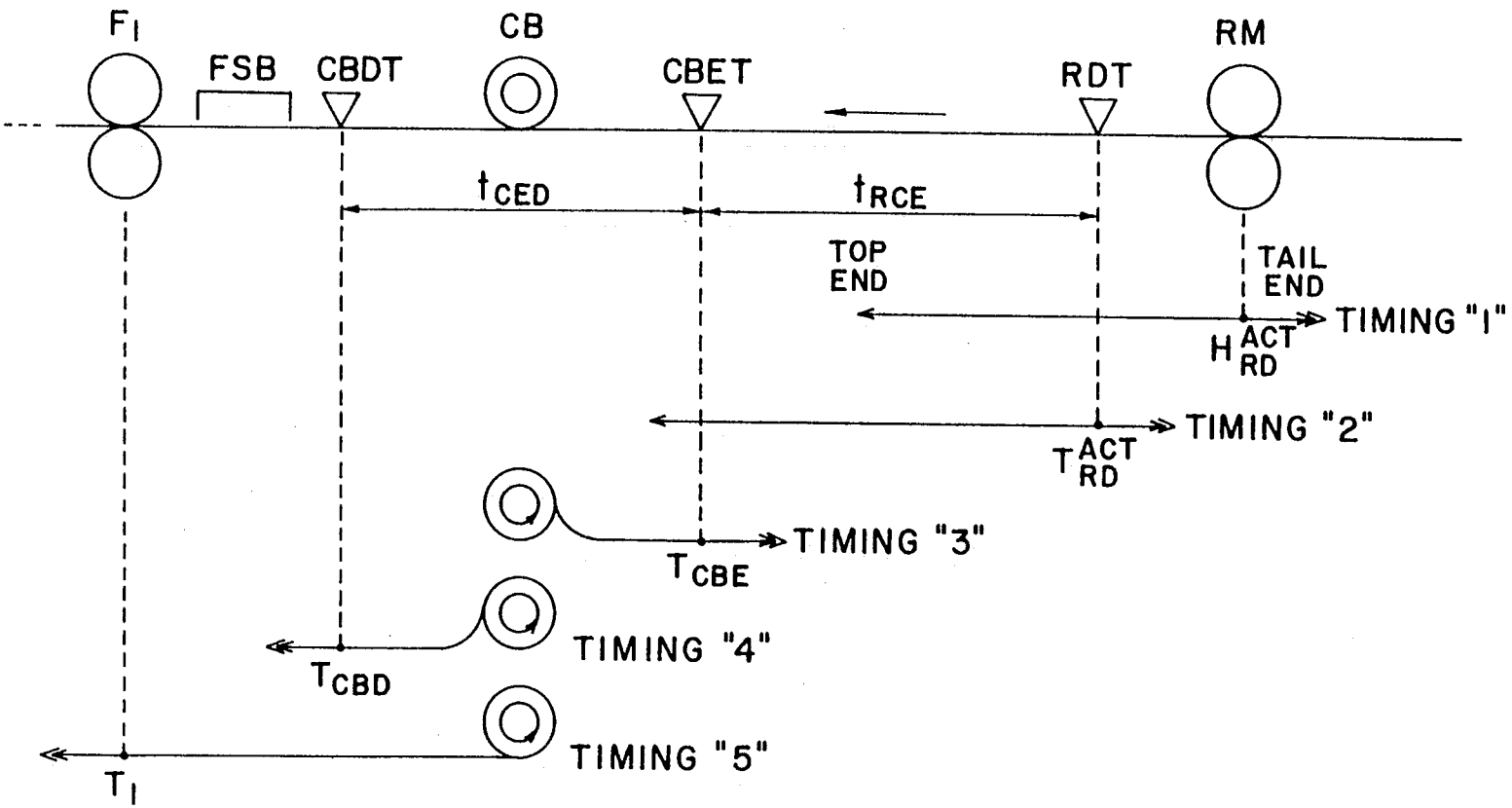
FIG. 2 is a timing chart showing an operation of the embodiment shown in FIG. 1.

An operation of the apparatus shown in FIG. 1 will be described with reference to FIG. 2.

First, at a time 1 when the tail end portion of the bar, which is assigned as to be measured, reaches the roughing mill RM in the last pass, the thickness $H_R^{ACT}$ of the bar is Calculated by the thickness calculator 1 on the basis of the roll gap $S^{ACT}$ and the rolling force $P^{ACT}$ of the roughing mill RM.

Then, at time 2 when the tail end portion of the bar reaches the pyrometer RDT disposed on the delivery side of the roughing mill, the surface temperature $T_{RD}^{ACT}$ of the bar is measured thereby and the average temperature $T_{RD,M}$ is calculated by the average temperature calculator 2 on the basis of the measured temperature $T_{RD}^{ACT}$ and the thickness $H_R^{ACT}$ calculated previously by the calculator 1.

Thereafter, at a time 3 when the tail end portion of the bar reaches the entry side detector CBET, the bar temperature $T_{CBE}$ at the position of the entry side detector CBET is calculated by the CB entry side temperature calculator 3 on the basis of the time $t_{RCE}$ required to move the tail end portion of the bar from the pyrometer RDT to the detector CBET, the average temperature $T_{RD,M}$ and the thickness $H_R^{ACT}$.

Then, the bar is wound and then rewound in the coil box CB. At a time 4 when the portion of the bar being rewound and which is the same as that whose temperature was measured by the pyrometer RDT, reaches the delivery side detector CBDT, the temperature $T_{CBD}$ of the bar at the position of the delivery side detector CBDT is calculated by the CB delivery side temperature calculator 4 on the basis of the transportation time $t_{CED}$ of the bar from the time 3 to the time 4, the output $T_{CBE}$ of the CB entry side calculator 3 and the thickness $H_R^{ACT}$. The roll speeds $V_i$ of the respective mill stands $F_i$ are calculated by the roll speed calculator 5 on the basis of the bar temperature $T_{CBD}$ obtained at the time 4, the objective value $T_{FD}^{AIM}$ of the strip temperature at the delivery side of the finishing mill and the objective strip thicknesses $h_i$ at the respective stands $F_i$. The workpiece temperatures $T_i$ at the respective mill stands $F_i$ are calculated by the finishing mill stand temperature calculator 6 on the basis of the calculated roll speeds $V_i$, the bar temperature $T_{CBD}$ and the objective thickness values $h_i$.

The calculations or operations to be performed by the respective calculator can be easily realized by the software of a universal computer.

As described hereinbefore, according to the present invention, the bar temperature on an entry side of the coil box is not calculated from the surface temperature on a delivery side of the roughing mill but from an average temperature obtained by operations. The bar temperature drop during transportation thereof on the delay table from the roughing mill through the coil box to the finishing mill is obtained by only one calculation. By determining the strip temperatures at respective stands of the finishing mill in this manner, it is possible to easily and precisely obtain the strip temperature and thickness of the strip on the delivery side of the finishing mill.

What is claimed is:

1. A method of determining a metal temperature of a bar in a hot strip mill having a roughing mill, a finishing mill including a plurality of mill stands and a coil box disposed between said roughing mill and said finishing mill, said method comprising a first step of setting a roll gap and a rolling force of said roughing mill when a tail end portion of said bar reaches said roughing mill and calculating a bar thickness at a delivery side of said roughing mill on the basis of said roll gap and said rolling force, a second step of detecting a surface temperature of said bar when said tail portion of said bar exits said roughing mill and calculating an average temperature of said bar in the direction of the thickness thereof on the basis of said surface temperature and said bar thickness, a third step of measuring a transportation time of said bar from said roughing mill to the entry side of said coil box and calculating a temperature of said bar at an entry side of said coil box on the basis of said transportation time of said bar from said roughing mill to the entry side of said coil box, said bar thickness and said average temperature, a fourth step of measuring a transportation time of said bar from said entry side to said delivery side of said coil box and calculating the temperature of said bar at a delivery side of said coil box on the basis of said transportation time of said bar from said entry side to said delivery side of said coil box, said bar thickness and said temperature of said bar at said entry side of said coil box, a fifth step of calculating roll speeds of said respective mill stands of said finishing mill on the basis of said temperature of said bar at said delivery side of said coil box, an objective temperature value at a delivery side of said finishing mill and objective thickness values of said bar at said respective mill stands of said finishing mill, and a sixth step of calculating the temperature of said strip at said respective mill stands of said finishing mill on the basis of said temperature of said bar at said delivery side of said coil box, said roll speeds at said respective stands of said finishing mill and said objective thickness at said respective stands of said finishing mill.

2. The method as claimed in claim 1, wherein said first step of calculating is performed by using a rolling force and roll gap setting values of a final pass of said roughing mill and a mill modulus.

3. The method as claimed in claim 1, wherein said second step comprises a calculation of said average temperature of said bar in the direction of the thickness and according to a linear equation on the basis of the detected surface temperature of said bar when said tail end portion of said bar exits said roughing mill and a value proportional to said bar thickness at said delivery side of said roughing mill.

4. An apparatus for determining a metal temperature of a bar in a hot strip mill having a roughing mill, a finishing mill including a plurality of mill stands and a coil box disposed between said roughing mill and said finishing mill, said apparatus comprising first means for setting a roll gap and a rolling force of said roughing mill when a tail end portion of said bar reachers said roughing mill and for calculating a bar thickness at a delivery side of said roughing mill on the basis of said roll gap and said rolling force, second means for measuring a surface temperature of said bar when said tail end portion of said bar exits said roughing mill and for calculating an average temperature of said bar in the direction of thickness thereof on the basis of said surface temperature of said bar and an output of said first means, third means for measuring a transportation time of said bar from said roughing mill to the entry side of said coil box and for calculating a temperature of said bar at an entry side of said coil box on the basis of said transportation time of said bar from said roughing mill to the entry side of said coil box, said output of said first means and an output of said second means, fourth means for measuring a transportation time of said bar from said entry side to said delivery side of said coil box and for calculating the temperature of said bar at a delivery side of said coil box on the basis of said transportation time of said bar from said entry side to said delivery side to said coil box, said output of said first means and an output of said third means, fifth means for calculating roll speeds of said respective mill stands of said finishing mill on the basis of an output of said fourth calculation means, an objective temperature value at a delivery side of said finishing mill and objective thickness values of said bar at said respective mill stands of said finishing mill, and sixth means for calculating the temperature of said bar at said respective mill stands of said finishing mill on the basis of said output of said fourth means, an output of said fifth means and said objective thickness at said respective stands of said finishing mill.

5. The apparatus as claimed in claim 4, wherein said first means calculates said bar thickness by using a rolling force and roll gap setting values for a final pass of said roughing mill and a mill modulus.

6. The apparatus as claimed in claim 4, wherein said second means calculates said average temperature of said bar in the direction of the thickness thereof and according to a linear equation by using the detected surface temperature of said bar when a tail end of said bar exits said roughing mill and a value proportional to the bar thickness at said delivery side of said roughing mill.

7. The apparatus as claimed in claim 4, further comprising an entry side detector and a delivery side detector for detecting the passage of said bar through an entry side and a delivery side of said coil box to thereby measure said transportation time from said entry side to said delivery side.

8. A method of determining a metal temperature of a bar in a hot strip mill having a roughing mill, a finishing mill including a plurality of mill stands and a coil box disposed between said roughing mill and said finishing mill, said method comprising a first step of conveying said bar through said roughing mill and setting a roll gap and a rolling force of said roughing mill when a tail end portion of said bar reaches said roughing mill and calculating a bar thickness at a delivery side of said roughing mill on the basis of said roll gap and said rolling force.

a second step of detecting a surface temperature of said bar when said tail portion of said bar exits said roughing mill and calculating an average temperature of said bar in the direction of the thickness thereof on the basis of said surface temperature and said bar thickness, a third step of conveying said bar to an entry side of said coil box and measuring a transportation time of said bar from said roughing mill to the entry side of said coil box and calculating a temperature of said bar at said entry side of said coil box on the basis of said transportation time of said bar from said roughing mill to the entry side of said coil box, said bar thickness and said average temperature, a fourth step of conveying said bar from said entry side to said delivery side of said coil box and measuring a transportation time of said bar from said entry side to said delivery side of said coil box and calculating the temperature of said bar at a delivery side of said coil box on the basis of said transportation time of said bar from said entry side to said delivery side of said coil box, said bar thickness and said temperature of said bar at said entry side of said coil box, a fifth step of conveying said bar through successive finishing stands and calculating roll speeds of said respective mill stands of said finishing mill on the basis of said temperature of said bar at said delivery side of said coil box, an objective temperature value at a delivery side of said finishing mill and objective thickness values of said bar at said respective mill stands of said finishing mill, and a sixth step of calculating the temperature of said strip at said respective mill stands of said finishing mill on the basis of said temperature of said bar at said delivery side of said coil box, said roll speeds at said respective stands of said finishing mill and said objective thickness at said respective stands of said finishing mill.

9. An apparatus for milling a metal bar in a hot strip mill, said apparatus comprising a roughing mill, a finishing mill including a plurality of mill stands, a coil box disposed between said roughing mill and a finishing mill, first means for setting a roll gap and a rolling force of said roughing mill when a tail end portion of said bar reaches said roughing mill and for calculating a bar thickness at a delivery side of said roughing mill on the basis of said roll gap and said rolling force, second means for measuring a surface temperature of said bar when said tail end portion of said bar exits said roughing mill and for calculating an average temperature of said bar in the direction of thickness thereof on the basis of said surface temperature of said bar on the basis of an output of said first means, third means for measuring a transportation time of said bar from said roughing mill to the entry side of said coil box and for calculating a temperature of said bar at an entry side of said coil box on the basis of said transportation time of said bar from said roughing mill to the entry side of said coil box, said output of said first means, and an output of said second means, fourth means for measuring a transportation time of said bar from said entry side to said delivery side of said coil box and for calculating the temperature of said bar at a delivery side of said coil box on the basis of said transportation time of said bar from said entry side to said delivery side to said coil box, said output of said first means, and an output of said third means, fifth means for calculating roll speeds of said respective mill stands of said finishing mill on the basis of an output of said fourth calculation means, an objective temperature value at a delivery side of said finishing mill and objective thickness values of said bar at said respective mill stands of said finishing mill, and sixth means for calculating the temperature of said bar at said respective mill stands of said finishing mill on the basis of said output of said fourth means, an output of said fifth means and said objective thickness at said respective stands of said finishing mill.

* * * * *